US006679151B1

(12) United States Patent
Rexroad

(10) Patent No.: US 6,679,151 B1
(45) Date of Patent: Jan. 20, 2004

(54) SHEATHED SHRINK NET AND SUPPORT ASSEMBLY

(76) Inventor: John Rexroad, 12 Jackson Rd., Killingworth, CT (US) 06419

( * ) Notice: Subject to any disclaimer, the term of this patent is extended or adjusted under 35 U.S.C. 154(b) by 0 days.

(21) Appl. No.: 09/404,085

(22) Filed: Sep. 23, 1999

(51) Int. Cl.[7] ..... D04C 1/02; D02G 3/02; D02G 3/36

(52) U.S. Cl. ..... 87/6; 87/9; 57/210; 57/244

(58) Field of Search ..... 87/5, 6, 7, 8, 9, 87/11, 13; 182/82, 138; 57/210, 224, 238, 243, 244, 245, 211, 225, 226, 227, 228, 231

(56) References Cited

U.S. PATENT DOCUMENTS 4,170,921 A * 10/1979 Repass ..... 87/6
5,593,751 A * 1/1997 Yu et al. ..... 428/97
5,802,828 A * 9/1998 Adorno ..... 57/232
5,860,350 A * 1/1999 Rexroad ..... 87/6
5,934,168 A * 8/1999 Feichtinger et al. ..... 87/8

* cited by examiner

*Primary Examiner*—John J. Calvert
*Assistant Examiner*—Shaun R Hurley
(74) *Attorney, Agent, or Firm*—Ellis & Venable, P.C.; Lance C. Venable

(57) ABSTRACT

A flexible member used as a rope in a mesh has an outer sheathing which is easy to touch and an inner core which is shrinkable so that when used in a mesh which is suspended on a frame, it pulls the frame tautly by the shrinkage of the inner cords. Also, a connection between a support member and a border can be effected using one way mechanical fasteners. Shrink nets can be further used on a frame without sheathing with a twisted cord.

11 Claims, 9 Drawing Sheets

SHEATHED SHRINK NET AND SUPPORT ASSEMBLY

CROSS-REFERENCE TO RELATED APPLICATIONS

The present invention relates to U.S. application Ser. No. 08/153,624 entitled Improved Climbing Net, filed in the name of Rexroad et al. on Nov. 17, 1993 and also relates to U.S. application Ser. No.: 08/414,185 entitled Hollow Braid Net and Method of Making, now, U.S. Pat. No. 5,860,350, filed Mar. 31, 1995 and further relates to U.S. application Ser. No. 08/557,851, entitled Net With Flattened Surface Members Connected At Sewn Intersection, now, U.S. Pat. No. 5,752,459, and U.S. application Ser. No. 09/193,989 entitled Shrink Net and System, filed Nov. 11, 1998.

BACKGROUND OF THE INVENTION

Field of the Invention

The present invention relates to nets, and particularly, to those found in barrier or play environments, and relates more particularly, to shrink netting whereby the mesh of the net is capable of being made taught about a frame through the intermediary of a shrinkable net fiber which has a reduced length once wetted and dried.

It is often desirable to maintain a net mesh in a taught condition while it is held in place on a structure. For example, in the case of a barrier net used for constraining people from going past a given point, such as on a hazardous ledge or the like, it is desirable to maintain the person against movement beyond a given plane without allowing undesirable play in the netting to occur. Such play can only result in additional exposure to danger which otherwise would not occur if the net had remained taut.

Also, it is desirable in other environments, such as in a playscape, or the like, to provide a netting station which is firm to the grip and does not cause the net to be unstable when climbed. Additionally, in a playground environment, it is desirable to provide a mesh which is soft to the touch when climbed by children. That is, in the playground environment, although a net is made stable by virtue of its being shrunk taught about a frame such as disclosed in copending U.S. application Ser. No. 09/193,989, entitled, Shrink Net And System, which application being commonly owned by the present inventor, it is still desirable to provide a taught net which can be climbed by a child for example, without shoes and without worry about scratches from gripping an abrasive mesh such that holding of the rails and rungs of the net will not result in abrasion of the person's skin.

Accordingly, it is an object of the present invention to provide an improved shrinking net whereby the net is capable of being shrunk in size to allow pretensioning of the mesh on the frame yet provides a soft and easy to touch mesh for use by children.

It is still a further object of the invention to provide a netting of the aforementioned type wherein the tensioning of the net can be effected readily and without complication.

Other objects and advantages of the invention will become apparent from the appended claims and the following disclosure.

SUMMARY OF THE INVENTION

The invention resides in a flexible member for netting comprising a sheathing made from a flexible synthetic material and having a hollow internal confine extending therewithin. An elongated core member is located within the internal confine of the sheathing and the core member has a plurality of fibers extending longitudinally along the length thereof. The fibers are of a shrinkable material which when wetted and dried cause the flexible member to decrease in length. Means is provided for causing a corresponding length of the sheathing and the core member to become secured against the movement relative to one another such that upon wetting of the internal core member and subsequently drying, the flexible member and the sheathing are reduced in length.

In one embodiment, the internal core member takes the form of a flat braided rope and the flat braid rope of the core member is disposed within the internal confine of the sheathing such that the sheathing has a generally rectangular shape as seen in side view and is generally defined by first and second spaced long sides extending parallel to one another and by first and second short sides each connected to and extending generally perpendicularly to the first and second long sides and extending parallel to one another to define therewithin the hollow internal confine. Ideally, the sheathing is a multi-filament material formed from color fast polypropylene. The flexible member may be one of a plurality of such members arranged in a lattice of a plurality of the members disposed substantially coplanar with one another such that the long sides thereof overlap at intersections with one another at predetermined angles and being stitched at the intersections thereof.

In another embodiment, the internal core is a generally cylindric twisted rope and the flexible member is one of a plurality of such members arranged in a lattice of a plurality of such members disposed substantially coplanar with one another intersecting at predetermined spacings such that one member pierces the sheathing and core and passes through it and the other member pierces the one member sheathing and core of the one member and passes through it a nodal point to effect securement of the core and the sheathing in unity with one another. Preferably, the flexible member sheathing is formed of a multi-filament polypropylene material having a diamond braided configuration.

In another embodiment, the flexible member comprises a plurality of strands being a composite of elongated materials twisted to form a cord. Each of the cords has a plurality of elongated polyester or multi-filament strands intermixed with one of a plurality of yarns that shrink when wetted. The cords are twisted with one another to create the generally cylindrical cord.

The invention further resides in a method of supporting a net along a support member comprising the steps of: providing a support member having a generally elongated extent and having a given diameter; providing a plurality of lock fasteners which have a free end which connects to an opposite end to create a variably constraining diameter when pulled tight; providing a net having a border with warp and weft members extending generally perpendicularly thereto to define spaces therebetween; stretching the border along the support member and fastening the border member to the support member using the lock fasteners by wrapping the fastener about the net border and the support member in the spacing and pulling the free end of the fastener through a locking mechanism to lock the fastener in place.

Ideally, the method may be characterized by providing a net having a border which has a generally rectangular shape defined by first and second spaced apart long sides extending parallel to one another and first and second short sides each connected to and extending generally perpendicular to the first and second long sides and extending parallel to one another and locating the long sides of the border flat against the support member and securing the border to the support member with the lock fasteners.

The invention further resides in a system for supporting a net along a support member comprising a support member having a generally elongated extent and having a given diameter. A plurality of lock fasteners which have a free end which connects to an opposite end to create a variably constraining diameter when pulled tight. A net having a border with warp and weft members extending generally perpendicularly thereto to define spaces therebetween. The border being stretched along the support member and fastened to the support member using the lock fasteners by wrapping the fasteners about the net border and the support member in the spaces and the free end of the fastener being pulled through a locking mechanism to lock the fastener in place with the border and the support member. Preferably, a rubberized sleeve is disposed about the lock fasteners and the border is clamped about the support element in the region of the rubberized sleeve.

BRIEF DESCRIPTION OF THE DRAWINGS

FIG. 1A showing more of the outer sheathing, FIG. 1B showing more of the inner shrinking core and FIG. 1C showing in cutaway the relationship between the inner and outer components.

DETAILED DESCRIPTION OF THE PREFERRED EMBODIMENT

Figure 1A:
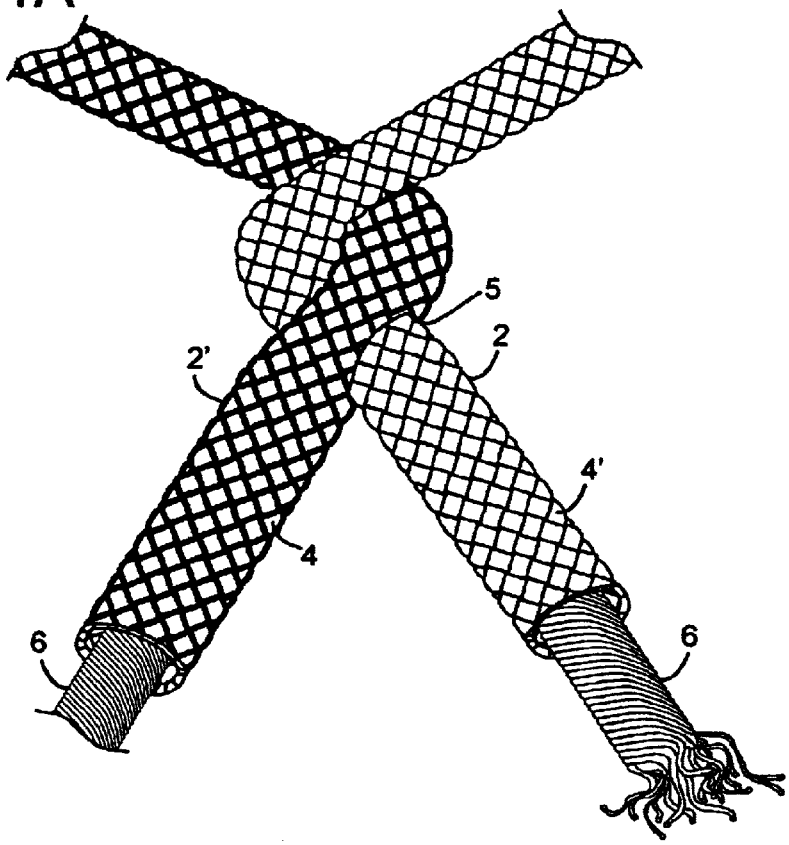
FIGS. 1A and 1B show a braided knotted rope each with an inner braided rope core made of fiber that shrinks.
Figure 1B:
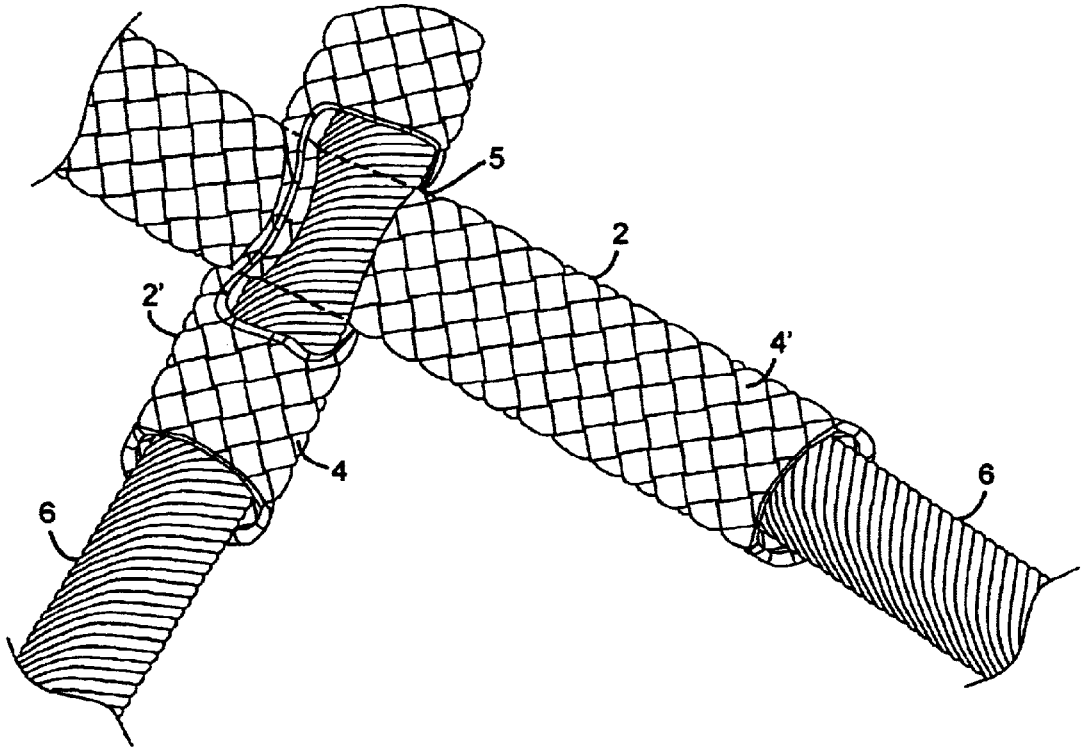
Figure 1C:
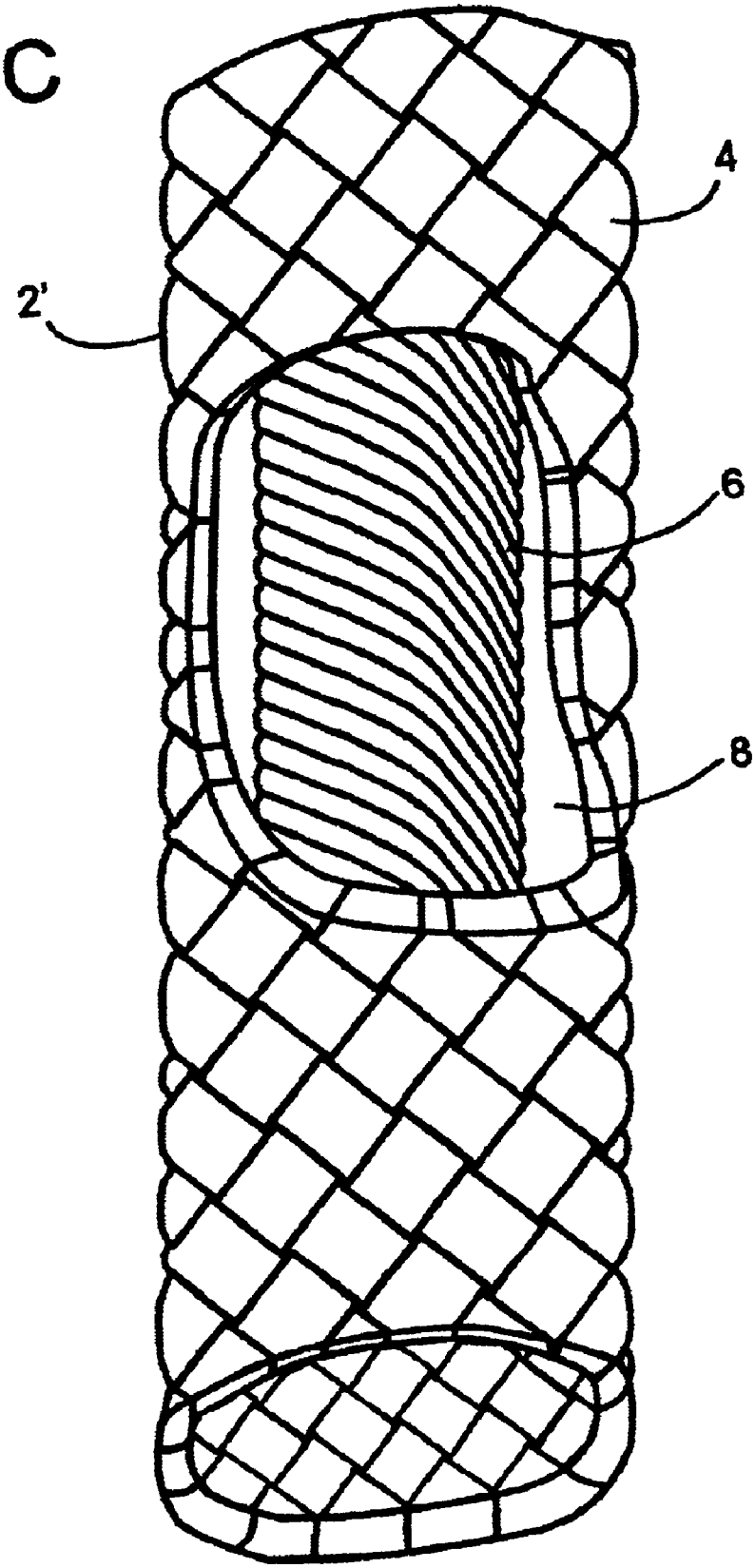

Referring now to FIGS. 1A–1C, it should be seen that a first embodiment of the invention is disclosed and is illustrated as an elongated member referenced generally by the numerals 2, 2'.

The elongated member 2,2' has a two component construction comprised of an outer sheathing 4 and an inner core 6. As is disclosed previously, for example, in U.S. Pat. No. 5,860,350, the sheathing 4 is made of a color fast diamond braided multi-filament polypropylene hollow rope which his commercially available and sold by Golf Rope and Cordage Inc. of Mobile, Ala. under Part No. 30822-07-3311A.

Disposed within the internal hollow confine 8 of the sheathing 4 is the shrink cord 6. In the embodiment illustrated in FIGS. 1A–1C, the shrink cord 6 takes the form of a braided rope having yarns which are formed from a material which shrink along their elongated extent when wetted and dried. These yarns are sold by Kuraray Co. Ltd. under the trade name KURALON Type-T rope through the Kawashaima Trading Co., Ltd., 1-6-28, KYUTARO-MACHI, CHUO-KU, Osaka, Japan. For more complete description of the properties of the yarns making up the shrink cord 6, reference is made to copending U.S. application Ser. No. 09/193,989, which application is being hereby incorporated by reference into the present case.

The following is a listing of the properties of the yarns are sold by Kuraray Co. LTD. under the tradename, Kuralon Type-T rope, through Kawashima Trading Co. as employed by the present invention.

TABLE A

1. Properties of Water Soluble Kuralon Perlohke Yarn

In addition to the soluble property in hot water, water soluble Kuralon perlohke yarn has the characteristic of remarkable high shrinkage force in water.
1. Characteristics of water soluble Kuralon perlohke yearn.
(1) High shrinkage ratio in wet state.
40% at free tension
(2) High shrinkage force in wet state.
In case of 10's, the shrinkage force is about 30 gr. When the both ends of yarn are fixed.
(3) High elongation at break.
(4) At wet state it shows elasticity like rubber.
(5) Abrasion resistance at wet state is a little inferior to that of normal Kuralon perlohke yearn.
(6) Tensile strength is about half of normal Kuralon perlohke yarn.
(7) It dissolves in water at more than 80° C.
8) Standard Properties of Kuralon Yarn.

| Description | 2005P20/1T | 2005P10/1T |
|---|---|---|
| Yarn Count | ECC 20'S | ECC 10'S |
| Dry | | |
| Tensile Strength Kg | 0.60 | 1.70 |
| Tenacity g/dr. | 2.20 | 3.01 |
| Elongation % | 15.0 | 17.0 |
| Wet | | |
| Tensile Strength Kg | 0.25 | 0.49 |
| Tenacity g/dr. | 0.92 | 0.87 |
| Elongation % | 102 | 108 |

In addition to the specific characteristics above in Table A, below listed in TABLE B, are further characteristics illustrative of the yarn material used by the present invention.

TABLE B

KURALON (PVA) HIGH SHRINKAGE CORD

This yarn exhibits the unique behavior of fast shrinkage combined with a high shrinkage force when it becomes wet.
1) Initial Reactive Properties
(a) Fast shrinkage:

The time required to reach 30% shrinkage is about 7 seconds in water at 20 Deg. C and about 4 seconds in water at 30 Deg. C.
(b) High shrinkage:

The shrinkage ratio is about 75% in water at 20 Deg. C. and about 78% in water at 30 Deg. C.
(c) High shrinkage force:

TABLE B-continued

| KURALON (PVA) HIGH SHRINKAGE CORD | | |
|---|---|---|
| After absorbing water, a high shrinkage force is readily apparent. The shrinkage force is about 170 gram (0.1 gram/danier) in water at 30 Deg. C after 10 seconds. | | |
| 2) Long Term Properties | | |
| (a) High strength after shrinkage: | | |
| Strength is about 1 gram per denier after yarn is soaked for 16 hours. | | |
| (b) Elasticity can be maintained for a long time. | | |
| 3) Standard Properties | | |
| Denier | : | 1786 |
| Unit Length (meter/gram) | : | 5.0 |
| Moisture Content (%) | : | 9.2 |
| Strength (Kg) | : | 3.88 |
| Tenacity (gram/dr) | : | 2.17 |
| Elongation at Break (%) | : | 26.0 |

Referring now to FIGS. 1A and 1C, it should be seen that the internal confines 8 of each of the ropes 2, 2' is sufficiently large to permit the one rope numbered 2 to be pierced through by the other rope numbered 2' through both the outer sheathing 4 and the corresponding portion of the inner core 6 and vice versa to effect the cross-piercing arrangement shown in FIGS. 1A and 1B. It should further be appreciated that in embodiment of FIGS. 1A–1C, both the sheathing 4 and the shrink cord 6 take the form of a braided rope having yarns which are loosely woven so as to allow the other of the ropes 2, 2' to pierce and pass through them at a common location to effect a cross locking arrangement. For a more complete description of the manner by which such cross locking of ropes 2 and 2' occurs, reference can be had to copending U.S. application Ser. No. 08/153,623 which application is being hereby incorporated by reference.

Figure 2:
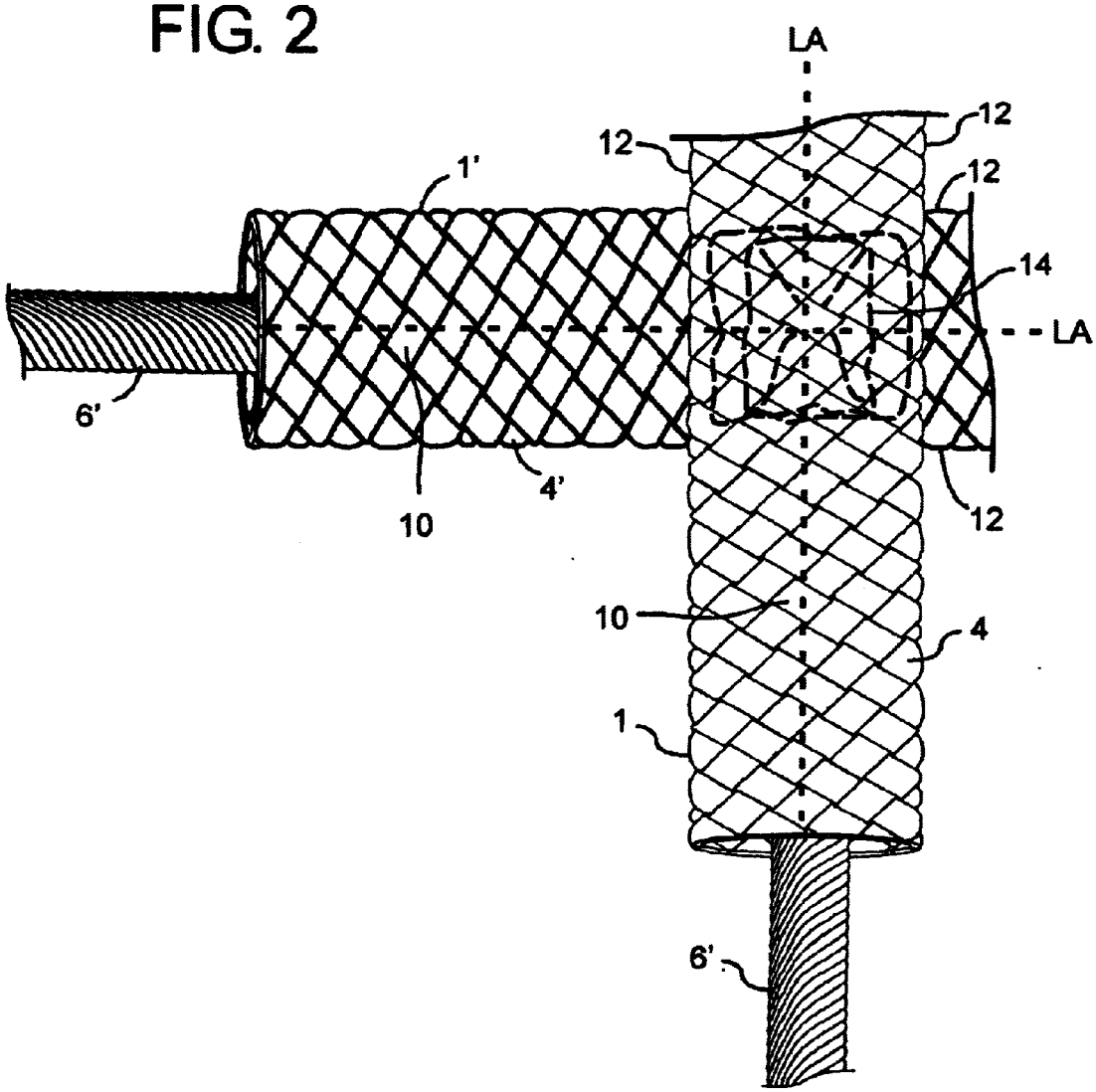
FIG. 2 shows a cross lock sewn connection between two perpendicularly disposed shrink net ropes.

Referring now to FIG. 2 and to the cross-shaped construction of the two intersecting flat ropes 1, 1', it should be seen that each rope is comprised of a sheathing member 4, 4' identical to that shown in FIGS. 1A–1C, but that the internal shrink cord referenced as 6' in FIG. 2 has a flat tightly braided rope configuration, rather than being loosely braided which permits the sheathing 4 to take on a more compact and tape-like configuration. That is, each of the sheathing members 4, 4' has two generally parallel disposed long side faces 10,10 which extend parallel to the longitudinal axis LA of the rope 1. Each sheathing member further has two short side faces 12,12 which are formed so as to be disposed perpendicularly to the long side faces 10,10 such that each rope 1,1' has a generally tape-like configuration. This tape-like configuration allows a flattened configuration of the rope members to occur.

A connection between the two ropes 1,1' can be effected by laying one rope flat on top of the other and stitching at the overlap 14. In the example shown, the stitching 14 occurs through the intermediary of a box stitch made through the overlapped ropes, however, other types of stitches can be used to effect the same type of connection. The box stitch 14 while not only effecting the connection between the intersecting sheathing members 4, 4', further serves to fix the coaxially disposed core members 6',6' to the sheathing in unity with one another.

Figure 3:
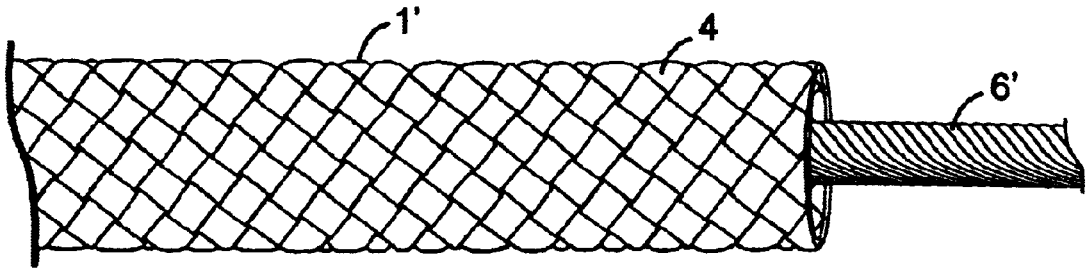
FIGS. 3 and 3A show, respectively, a sheathing with a flat braid rope of the type shown in FIG. 2 and a sheathing with a twisted or braided shrink rope.
Figure 3A:
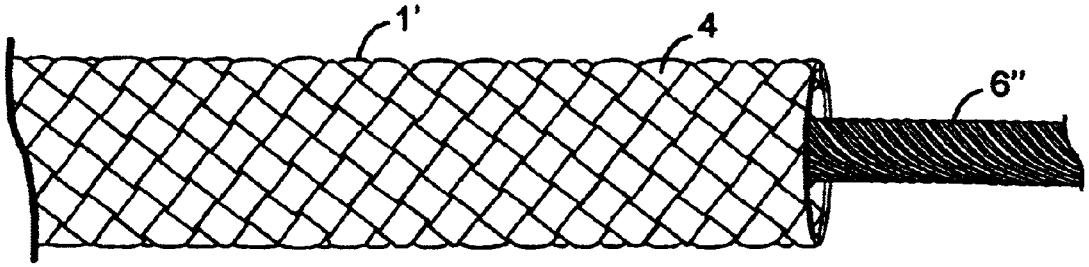
Figure 4:
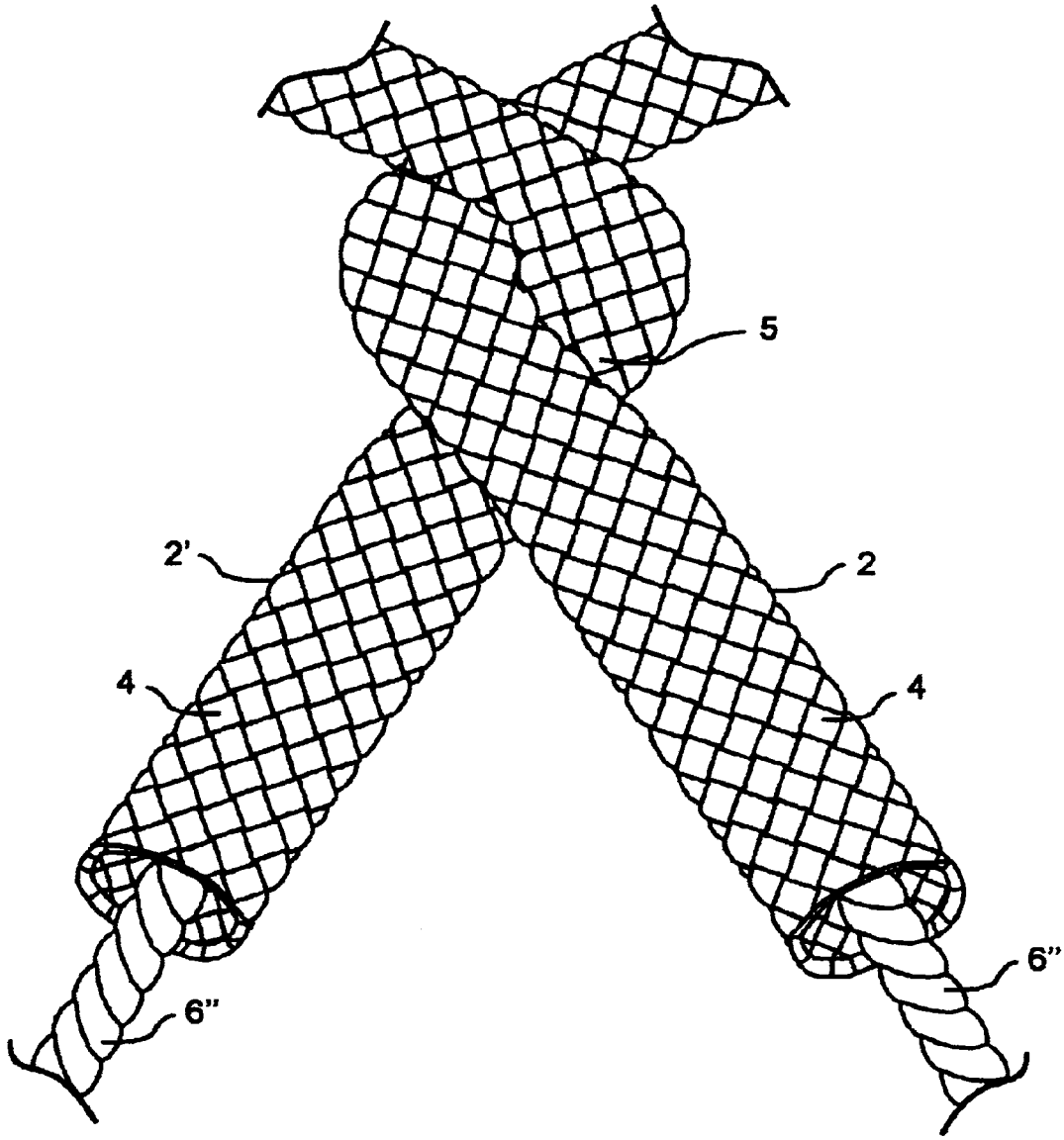
FIG. 4 shows a double pierce connection between two sheathed ropes wherein the inner core is a cylindrical twisted or braided rope.

It should be understood from a review of FIGS. 3 and 3A, that the characteristics of the core 6' can vary without substantially altering the effect of the ropes 1,1'. That is, the core 6' used in FIGS. 3 and 3A is a flat tightly braided rope in sheathing. However, as shown in FIGS. 3 and 4, the shrink cords 6" as shown therein are formed from the strands of shrink fiber from the material set forth above which are twisted into a cylindrical form rather than being braided to create a cylindrical rope, rather than one that is flattened. As illustrated in FIG. 4, the sheathing 4 being of the type disclosed in FIGS. 1A–1C is pliable and will take on a cylindrical shape of the internalized cylindrical shrink cord 6" inserted therein and thus is piercable at node 5 in manner set forth and discussed above with reference to FIGS. 1A and 1B.

Figure 5:
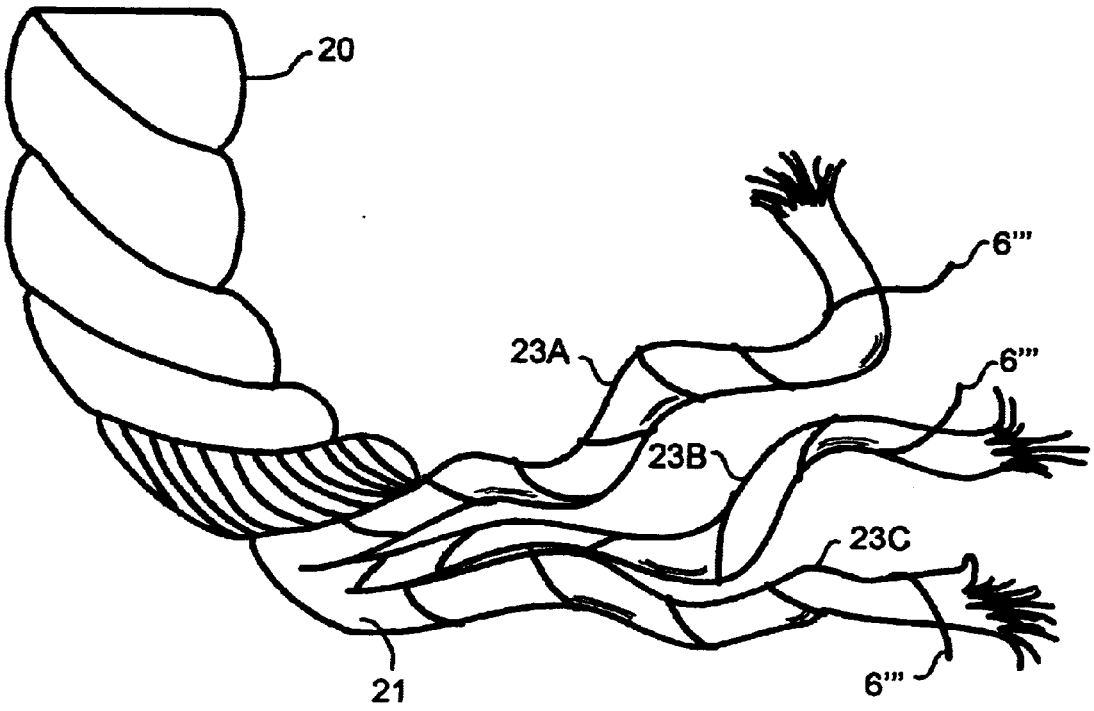
FIG. 5 shows an end view of a twisted rope with shrink rope filaments intertwisted within each of the separate cords which are made of polyester or other soft material.

Referring now to the further embodiment of FIG. 5, it should be seen that a twisted rope 20 which has a polyester or multi-filament polypropylene base material 21 between which are inter-dispersed lengths of shrink rope filaments 6'",6'". The lengths of the base material 21 and the lengths of shrink filaments are twisted together to form single independent cords 23*a*, 23*b* and 23*c* which are in turn twisted together to form the twisted rope 20. In this way, once wetted and allowed to dry, the rope 20 will be caused to shrink along its length through the shrinking action of the shrink elements 6'" working in the manner discussed above.

Figure 6:
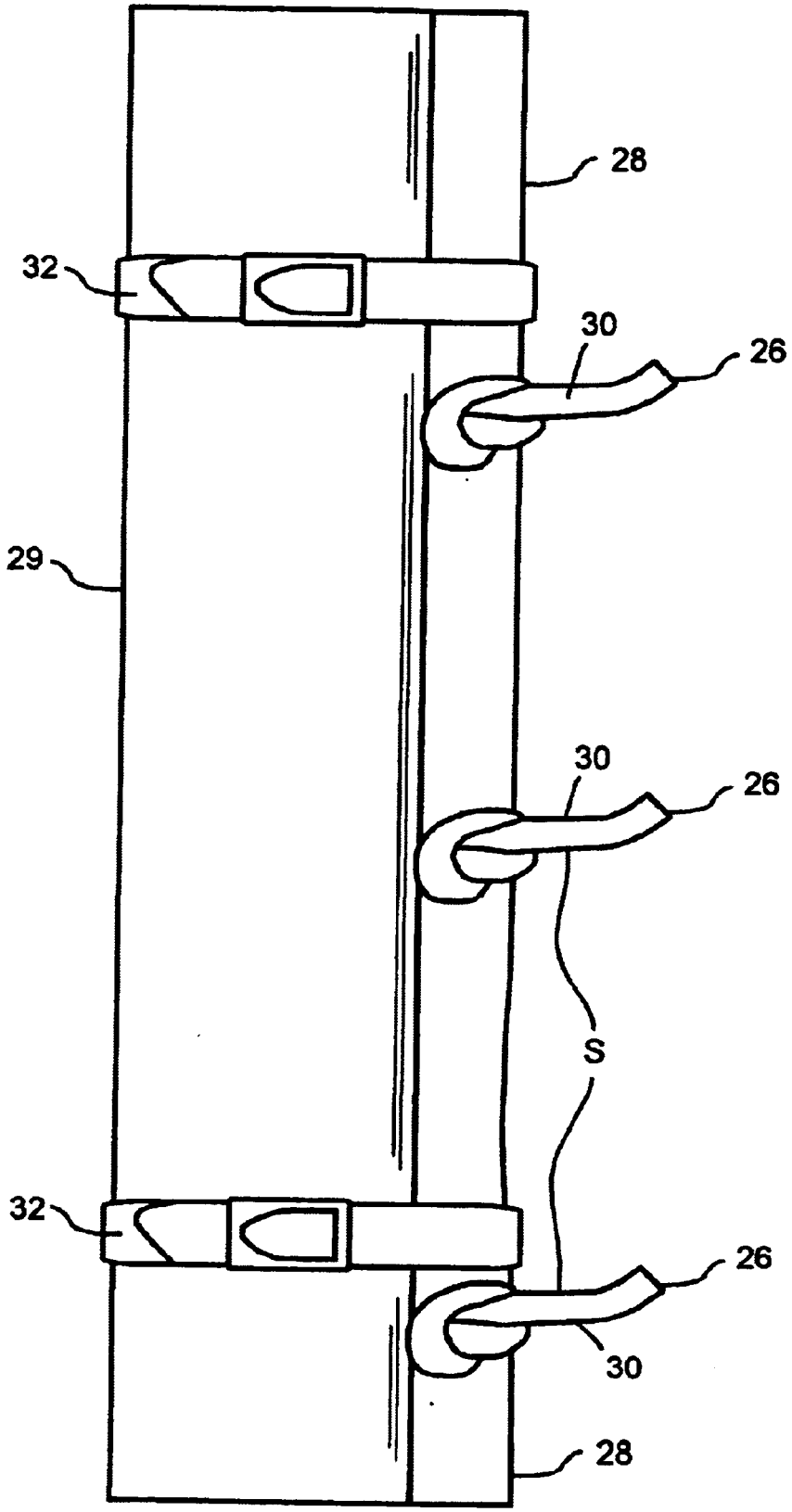
FIG. 6 is a partial fragmentary side elevation view of a connection between a structural number and the border of a knotted net.
Figure 7:
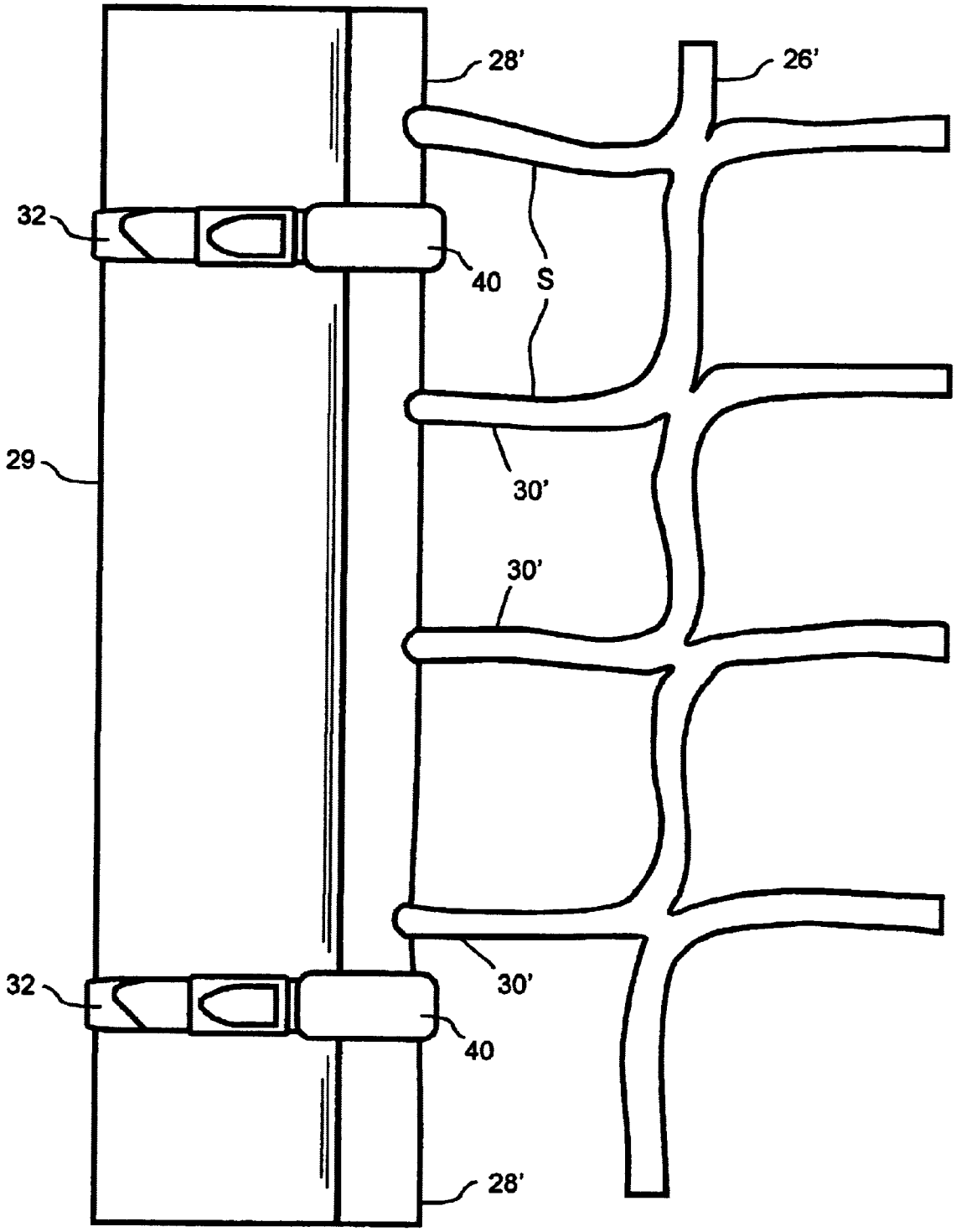
FIG. 7 is an alternative embodiment of the connection shown in FIG. 6 whereby the net is a knotless mesh.

Referring now to FIGS. 6–8, it should be seen that a system for supporting a net or mesh 26, 26' with a border is disclosed. The net illustrated in FIG. 6 as element 26 is one such as disclosed in FIG. 20 of U.S. Pat. No. 5,752,459, which is hereby incorporated by reference, or can be a knottless Rachel type net as illustrated in FIG. 7 which has no cross piercing members. In either case, the net 26,26' is of the type having a border 28, 28' which can extend lengthwise in a given direction so as to be stretched in a lengthwise dimension.

As seen in FIGS. 6 and 7, an elongate structural support element 29 is employed for securing with it a length of the border 28,28'. In so doing, the border 28,28' is stretched along the length of the element 29 and is connected to it in discrete places by means of a plurality of lock fasteners 32,32. The net disclosed in U.S. Pat. No. 5,752,459 is particularly useful in such an application in that it has flat side faces as defined by dimension W which are ideally suited for placement against the opposing surface of the member 29.

As is known, weft or warp members 30,30' of the mesh 26,26' connect to the borders 28,28 in a T-like connection so as to cause spacings S,S, therebetween. It is within the spacings that the lock fasteners 32,32 connect with the member 29. The lock fasteners 32,32 which are shown in greater detail in FIGS. 8A and 8B.

Figure 8A:
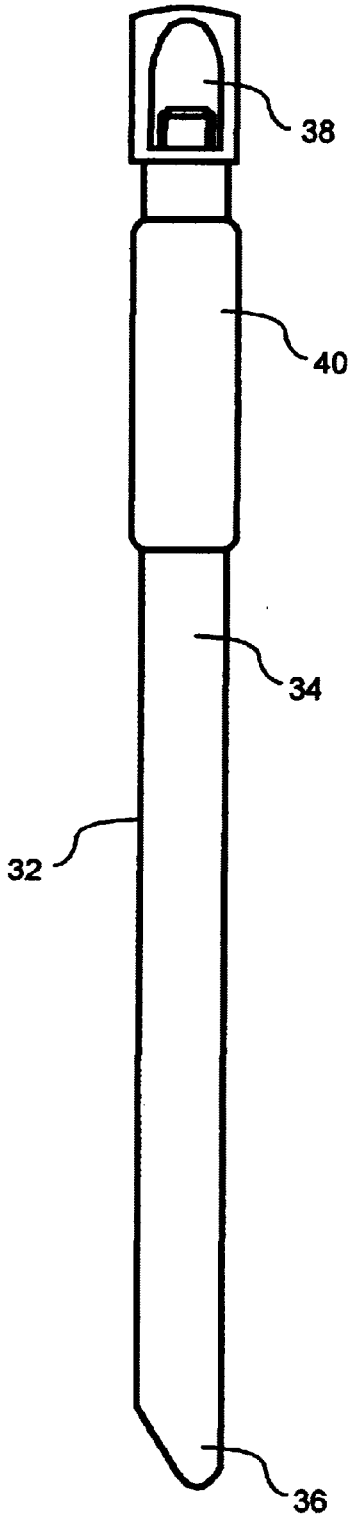
FIGS. 8A & 8B show respectively a fastener used in the connections of FIGS. 6 and 7 shown with a cover strap in FIG. 8A and in FIG. 8B shown without a cover strap.
Figure 8B:
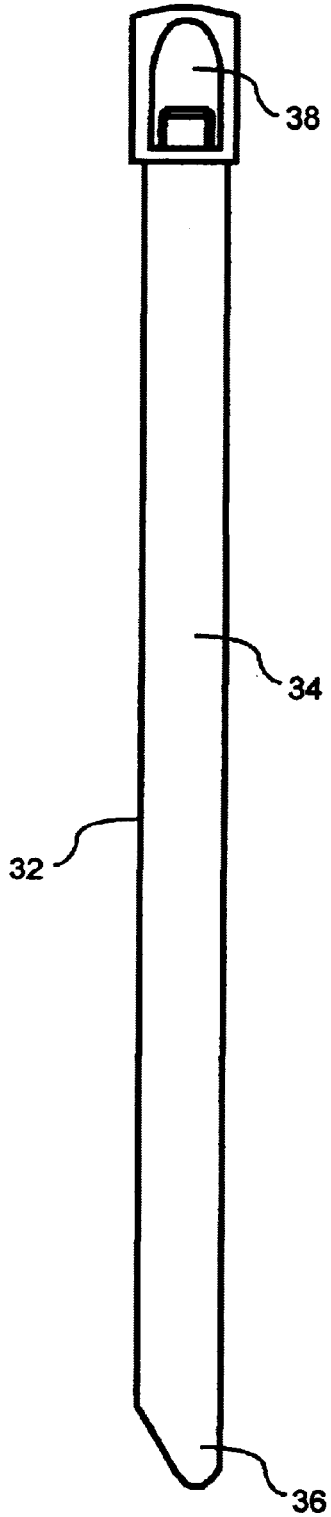

As seen in FIGS. 8A and 8B, each of the lock fasteners 32,32 is comprised of a generally flat tape-like piece of metal 34 having a tapered free end 36 which is adapted to be received within a one way, pull-out resistant locking mechanism 38 secured to the opposite end of the strip 34. It has been found that the substantial width of the metallic strip 34, for example, on the order of about one quarter inch, is effective to cause a desired bearing and clamping surface to be effected between the border 28,28' of the mesh 26,26' and the structural member 29 as well as between the lock fastener 32 and the member 29 which it contacts. To further enhance this bearing capacity, it is also desirable to use a rubberized bearing sleeve 40 which is disposed about the metallic strip portion for the fastener. The lock fasteners 32,32 are readily commercially available and are sold by Panduit Corporation, 17301 Richland Avenue, Tinley Park, Ill. 60477-3091.

Accordingly, Applicant has disclosed an improvement in shrink net technology which is neither obvious nor novel in order to illustrate the invention. However, numerous modifications and substitutions may be had without departing from the spirit of the invention. For example, with respect to the connection shown in FIGS. 6 and 7, it is well within the purview of the invention to provide the connection shown therein which uses no shrinkable fibers and simply connects a netting to a member as illustrated.

What is claimed is:

1. A net system comprising a frame having at least two opposing frame members and a net extending therebetween;

said net being made from a material of cords of a water soluble yarn capable of high shrinkage rates when wetted with water and dried;

means provided along one of said frame sides for causing tensioning of localized regions in said net; and wherein one of said border, weft and warp members is made in whole or in part from a shrinkable material when wetted and dried.

2. A flexible member as defined in claim 1 further characterized in that said internal core member takes the form of a flat braided rope.

3. A system as defined in claim 2 further characterized by said tensioning means includes a connecting rod extending along one of said frame members and threaded between the border and the weft and warp members.

4. A flexible member as defined in claim 3 further characterized by said sheathing being a multi-filament material formed from color fast polypropylene.

5. A flexible member as defined in claim 4 further characterized by said member being one of a plurality of such members arranged in a lattice of plurality of said members disposed substantially coplanar with one another such that said long sides thereof overlap at intersections with one another at predetermined angles and being stitched at the intersections thereof.

6. A flexible member as defined in claim 1 further characterized by said internal core member being a generally cylindric twisted rope.

7. A flexible member as defined in claim 6 further characterized by said flexible member being one of a plurality of such members arranged in the lattice of a plurality of such members disposed substantially coplanar with one another intersecting at predetermined spacings such that one member pierces the sheathing and core of the other and passes through it and the other member pierces the one member sheathing and core of the one member and passes through it a nodal point to effect securement of said core and said sheathing in unity with one another.

8. A flexible member as defined in claim 7 further characterized by said sheathing being formed a multi-filament polypropylene material.

9. A flexible member as defined in claim 8 further characterized by said sheathing being formed by a diamond braided configuration.

10. A flexible member comprising:

a plurality of elongated materials, said elongated materials further comprising a plurality of elongated polyester or multi-filament strands intermixed with one of a plurality of yarns which shrink when wetted and are twisted to form at least one cord, said at least one cords being twisted with one another to create said flexible member.

11. A flexible member as defined in claim 10 further characterized by said flexible member being an unsheathed member.

* * * * *

UNITED STATES PATENT AND TRADEMARK OFFICE

CERTIFICATE OF CORRECTION

PATENT NO. : 6,679,151 B1
DATED : January 20, 2004
INVENTOR(S) : John Rexroad

It is certified that error appears in the above-identified patent and that said Letters Patent is hereby corrected as shown below:

Column 7,
Line 9, claim 1, cancel the text beginning with "1. A net system" to and ending "when wetted and dried." in line 18, and insert the following claim:

1. A flexible member for netting comprising:
a sheathing made from a flexible synthetic material and having a hollow internal confine extending therewithin;
an elongated core member located within said internal confine of said sheathing;

said core member having a plurality of fibers extending longitudinally along the length thereof;

said fibers being of a highly shrinkable material which when wetted cause the core member to decrease in length; and means for causing a corresponding length of said sheathing and said core member to become secured against the movement relative to one another such that upon wetting of said internal core member, said flexible member and said sheathing are reduced in length.

Line 22, claim 3, cancel the text beginning with "3. A system as defined in claim 2" to and ending "the weft and warp members." in line 25, and insert the following claim:

3. A flexible member as defined in claim 2 further characterized by said flat braid rope of said core member being disposed within said internal confine of said sheathing such that said sheathing has a generally rectangular shape as seen in said view and being generally defined by first and second spaced long sides extending parallel to one another and by first and second short sides each connected to and extending generally perpendicularly to the first and second long sides and extending parallel to one another to define therewithin said hollow internal confine.

UNITED STATES PATENT AND TRADEMARK OFFICE

CERTIFICATE OF CORRECTION

PATENT NO. : 6,679,151 B1
DATED : January 20, 2004
INVENTOR(S) : John Rexroad

It is certified that error appears in the above-identified patent and that said Letters Patent is hereby corrected as shown below:

Column 8,
Line 21, claim 10, cancel the text beginning with "10. A flexible member comprising:" to and ending "create said flexible member." in line 28, and insert the following claim:

10. A flexible member comprising:

a plurality of elongated materials, said elongated materials further comprising a plurality of elongated polyester or other multi-filament strands intermixed with one of a plurality of yarns which is composed of a highly shrinkable material that reacts when wetted thereby shrinking, and said elongated materials are twisted to form at least one cord.

Signed and Sealed this

Twenty-first Day of September, 2004

JON W. DUDAS
*Director of the United States Patent and Trademark Office*